US010431920B1

(12) United States Patent
Tate

(10) Patent No.: US 10,431,920 B1
(45) Date of Patent: Oct. 1, 2019

(54) ONE-PIECE PARALLEL MULTI-FINGER CONTACT

(71) Applicant: John O. Tate, Lincoln, RI (US)

(72) Inventor: John O. Tate, Lincoln, RI (US)

( * ) Notice: Subject to any disclaimer, the term of this patent is extended or adjusted under 35 U.S.C. 154(b) by 0 days.

(21) Appl. No.: 16/190,773

(22) Filed: Nov. 14, 2018

Related U.S. Application Data

(60) Provisional application No. 62/658,632, filed on Apr. 17, 2018.

(51) Int. Cl.

| | |
|---|---|
| ***H01R 13/11*** | (2006.01) |
| ***H01R 43/16*** | (2006.01) |
| ***H01R 12/70*** | (2011.01) |
| ***H01R 13/20*** | (2006.01) |
| ***H01R 12/71*** | (2011.01) |

(52) U.S. Cl.
CPC ..... *H01R 13/11* (2013.01); *H01R 12/707* (2013.01); *H01R 12/7064* (2013.01); *H01R 12/718* (2013.01); *H01R 13/20* (2013.01); *H01R 43/16* (2013.01); *H01R 13/111* (2013.01)

(58) Field of Classification Search
None
See application file for complete search history.

(56) References Cited

U.S. PATENT DOCUMENTS 2,973,400 A 2/1961 McAdam
3,290,907 A 10/1966 Hoffman
3,518,493 A 6/1970 Bathrick, Jr. et al.
3,605,075 A 9/1971 Stofkooper
3,621,445 A * 11/1971 Horecky ..... B26B 3/03 174/267
3,917,375 A 11/1975 Johnson
4,494,814 A 1/1985 Oyama
4,529,260 A 7/1985 Smith
4,534,603 A * 8/1985 Brown ..... H01R 13/187 439/82
4,636,026 A * 1/1987 Cooney ..... G01R 1/06722 439/482
5,071,375 A * 12/1991 Savage, Jr. ..... H01R 13/187 439/853
5,667,413 A 9/1997 Trafton
5,909,056 A 6/1999 Mertol
6,352,437 B1 3/2002 Tate
(Continued)

OTHER PUBLICATIONS

Robinson, S., "Thermal issues count in high-power amp design," Engineering Village, IEE Power Electronics Technology, vol. 31, Issue 6, pp. 44-50, 2005 (Abstract Only).

*Primary Examiner* — Xuong M Chung Trans
(74) *Attorney, Agent, or Firm* — Barlow, Josephs & Holmes, Ltd.

(57) ABSTRACT

An electronic device socket includes a barrel having a lumen extending therethrough. The barrel includes a proximal barrel portion having a first outer diameter; a tapering region extending distally from the proximal barrel portion, the tapering region extending both distally and radially inward towards a central axis of the barrel; a plurality of fingers extending distally from the tapering region, the plurality of fingers are all parallel to one another and the central axis; and a dimple contact area extending from each of the plurality of fingers extending radially inward and distally. The barrel is configured to make full contact with an electronic pin only at the dimple contact area.

20 Claims, 12 Drawing Sheets

(56) References Cited

U.S. PATENT DOCUMENTS

| | | | |
|---|---|---|---|
| 6,373,131 | B1 | 4/2002 | Karmezos |
| 6,630,371 | B2 | 10/2003 | Hembree |
| 6,736,668 | B1 | 5/2004 | Kholodenko et al. |
| 7,086,870 | B1 | 8/2006 | Sutcliffe |
| 7,128,604 | B2 | 10/2006 | Hall |
| 7,230,830 | B2 | 6/2007 | Uijike et al. |
| 7,946,881 | B2 | 5/2011 | Hsieh et al. |
| 7,988,459 | B2 | 8/2011 | Ulen et al. |
| 8,062,933 | B2 | 11/2011 | Huang et al. |
| 8,422,233 | B2 | 4/2013 | Li et al. |
| 8,721,359 | B1 | 5/2014 | Tate |
| 2012/0104591 | A1 | 5/2012 | Warren et al. |
| 2013/0118008 | A1 | 5/2013 | Gaynes et al. |
| 2013/0119535 | A1 | 5/2013 | Joshi |
| 2013/0122656 | A1 | 5/2013 | Tomita et al. |
| 2013/0208428 | A1 | 8/2013 | Hui et al. |
| 2017/0302017 | A1 | 10/2017 | Inoue |

* cited by examiner

ONE-PIECE PARALLEL MULTI-FINGER CONTACT

CROSS-REFERENCE TO RELATED APPLICATION

This application is related to and claims benefit of U.S. Provisional Application No. 62/658,632 filed Apr. 17, 2018, entitled "ONE PIECE PARALLEL MULTI-FINGER CONTACT," the entire contents of which are incorporated herein by reference.

BACKGROUND AND SUMMARY OF THE DISCLOSURE

The present disclosure relates to electronic device sockets for electronic devices and more particularly to pin sockets.

Pin sockets are used to provide the ability to 1) attach an electronic device to a printed circuit board (PCB) without exposing the device leads to high solder temperatures, and 2) remove the device, as needed, without having to de-solder the device from the PCB. Traditionally, pin sockets are sold as discreet units or are connected to each other with an insulating material such as molded plastic or machined laminate.

Traditional pin sockets are designed and built as a two-piece electrical contact assembly consisting of a contact with multiple tapered fingers 2 press-fitted into the axial hole of a turned pin metal terminal 3, as shown in FIG. 1A. When a device lead is inserted into the pin socket which is soldered to the PCB 10, see e.g. FIG. 1B, it travels down the tapered fingers to the distal end of the contact through a lumen 4. Along the way, the device lead makes frictional contact with the proximal end 2*p* of the tapered fingers 2. This friction, or "wiping action," impacts the insertion, retention, and extraction forces, respectively i.e., the respective forces required to insert, keep in place, and withdraw a device lead to and from a socket. During insertion, the frictional forces between device lead and contact 1 is highest at the proximal end 2*p*, i.e., entry point, of the contact. The high mechanical force required to insert the device lead into the contact 1 entrance can damage the device lead or crack the device substrate.

Manufacturing a traditional pin socket conventionally requires eight (8) distinct manufacturing steps:

1) stamping metal to create a multi-finger contact,
2) forming the metal in order to taper the fingers,
3) heat treating the stamped and formed contact,
4) plating the contact,
5) machining a turned pin metal terminal,
6) plating the terminal,
7) inserting the plated contact into the plated terminal, and
8) probing each contact with a gauge pin in order to deflect the fingers enough to achieve a specified insertion, retention, and/or extraction force.

Each of these steps requires tight process and quality control. The probing step 8) is especially labor-intensive and adds significant cost to the manufacturing process of the socket. Further, correlating the customer's desired insertion, retention, and withdrawal force to a probing protocol involves a lot of trial-and-error, and yields both inconsistent results and added costs.

Therefore, there is a need for an improved design of a pin socket which reduces cost, reduces the complexity of manufacture, and increases the consistency of the results.

In a first embodiment, an electronic device socket is provided. The electronic device socket includes a barrel. The barrel includes a lumen, a proximal barrel, a tapering region, a plurality of fingers, and a dimple contact area. The barrel includes a lumen extending therethrough. The proximal barrel portion has a first diameter. The tapering region extends distally from the proximal barrel portion and, the tapering region extending both distally and radially inward towards a central axis of the barrel to define a second diameter which is smaller than the first diameter. The plurality of fingers extend distally from the tapering region and the plurality of fingers are all parallel to one another and the central axis. The dimple contact area extends from each of the plurality of fingers extending radially inward and distally.

In some embodiments, the plurality of fingers can be three fingers. In some cases, each of the dimples extend radially outward at a location distal to the radially inward section. The barrel can be configured to make full contact with an electronic pin only at the dimple contact area.

In still further embodiments the contact can be disposed in a printed circuit board by surface mounting or in a through-hole. The contact can include a solder tail extending distally therefrom to attach the contact to the printed circuit board. The contact can be soldered to the printed circuit board. The contact can include a tapered plug disposed in a distal end thereof. The contact can include a locking feature which locks the tapered plug into an undercut of the distal end of the contact. The socket can be one piece. The socket can be press fitted into an outer shell.

In another exemplary embodiment a one piece parallel multi-finger contact configured for mounting electronic devices to a printed circuit board is disclosed. The contact includes a barrel including a plurality of parallel beams and a point of contact. The barrel includes a first diameter. The plurality of parallel beams extend distally from the barrel, the plurality of beams are disposed about a second diameter which is smaller than the first diameter. The point of contact is distal to the plurality of parallel beams defined by a respective dimple on each of the plurality of parallel beams. The point of contact is radially inward of both the barrel and the plurality of parallel beams.

In some embodiments, the plurality of parallel beams can be parallel to a central axis of the contact. The plurality of parallel beams can be parallel to one another along a majority of the length of the contact. Each of the respective dimples can extend radially inward and distally from a respective parallel beams and then radially outward and distally. The plurality of parallel beams can be three parallel beams.

A method of manufacturing a one piece parallel multi-finger contact is additionally provided. The method includes only the steps of stamping a piece of metal to create a multi-finger contact; forming a dimple on a distal end each of the fingers of the multi-finger contact; heat treating the multi-finger contact; and plating the contact.

In some embodiments, the multi-finger contact can include a barrel, a plurality of fingers extending distally therefrom. Each of the fingers can be parallel to one another, and a respective dimple can extend distally from each of the plurality of fingers. In further embodiments the plurality of fingers can be parallel to one another along a majority of the length of the contact. Each of the respective dimples can extend radially inward and distally from a respective finger and then radially outward and distally. The steps of the disclosed method may be performed in any order.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1A:
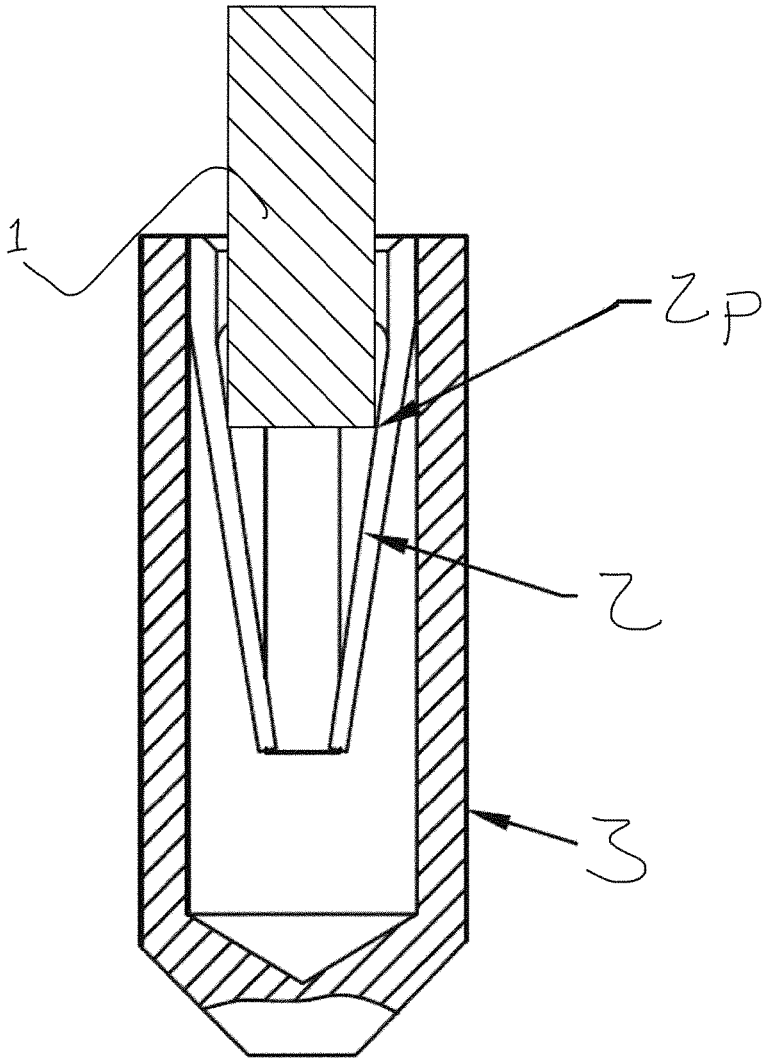
Fig. 1A Prior Art
FIG. 1A is a plan view of a prior art socket.
Figure 1B:
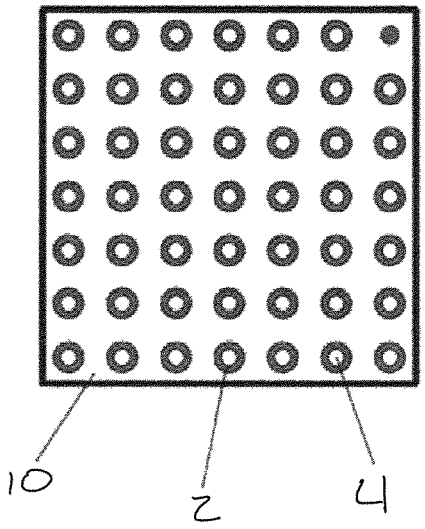
Fig. 1B Prior Art
FIG. 1B is a top view of a prior art printed circuit board.

Certain exemplary embodiments will now be described to provide an overall understanding of the principles of the structure, function, manufacture, and use of the device and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present disclosure. Further, in the present disclosure, like-numbered components of the embodiments generally have similar features, and thus within a particular embodiment each feature of each like-numbered component is not necessarily fully elaborated upon. Additionally, to the extent that linear or circular dimensions are used in the description of the disclosed systems, devices, and methods, such dimensions are not intended to limit the types of shapes that can be used in conjunction with such systems, devices, and methods. A person skilled in the art will recognize that an equivalent to such linear and circular dimensions can easily be determined for any geometric shape. Further, to the extent that directional terms like proximal, distal, top, bottom, up, or down are used, they are not intended to limit the systems, devices, and methods disclosed herein. A person skilled in the art will recognize that these terms are merely relative to the system and device being discussed and are not universal The instant electronic device socket, or contact, consists of a one-piece contact that can be unitary and manufactured from a single piece of material. In some embodiments, the contact can be disposed directly in, or on, the printed circuit board (PCB). In alternative embodiments the contact can be a two-piece contact having a contact receptacle and an outer shell. The contact, in general, provides a removable mechanism for attaching electronics to a PCB. A piece of an electrical circuit, including e.g., processors, resistors, capacitors, diode, LEDs, etc., can have a plurality of electrical leads which can be attached to a PCB with a variety of electrical connections. If a component needs to be removed from a PCB, an of the leads of the component, the component itself, or the PCB can become damaged if the leads are directly soldered to the PCB. Thus, a detachable contact can provide an efficient mechanism to attach component leads to a PCB. Should a component need to be replaced, or if the circuit has been incorrectly assembled, or damaged, the contact can provide a mechanism to remove the component from the circuit without causing damage to the component. However, as noted above, traditional contacts suffer from high frictional forces with the leads which in turn can damage the lead or crack the device substrate. Moreover, traditional contacts require a large number of manufacturing steps which add to the costs and complexity of manufacturing. As such, there is a need for an improved contact which can reduce the costs and complexity of the manufacturing process while simultaneously improving the reliability and consistency of the end product. This end goal can be achieved by a redesigned contact which is manufactured with a less complex manufacturing process. The design of the contact will reduce withdrawal and retention forces, as required, to improve the wear of device leads as they are inserted and withdrawn from the contacts, as will be discussed further below.

Figure 2A:
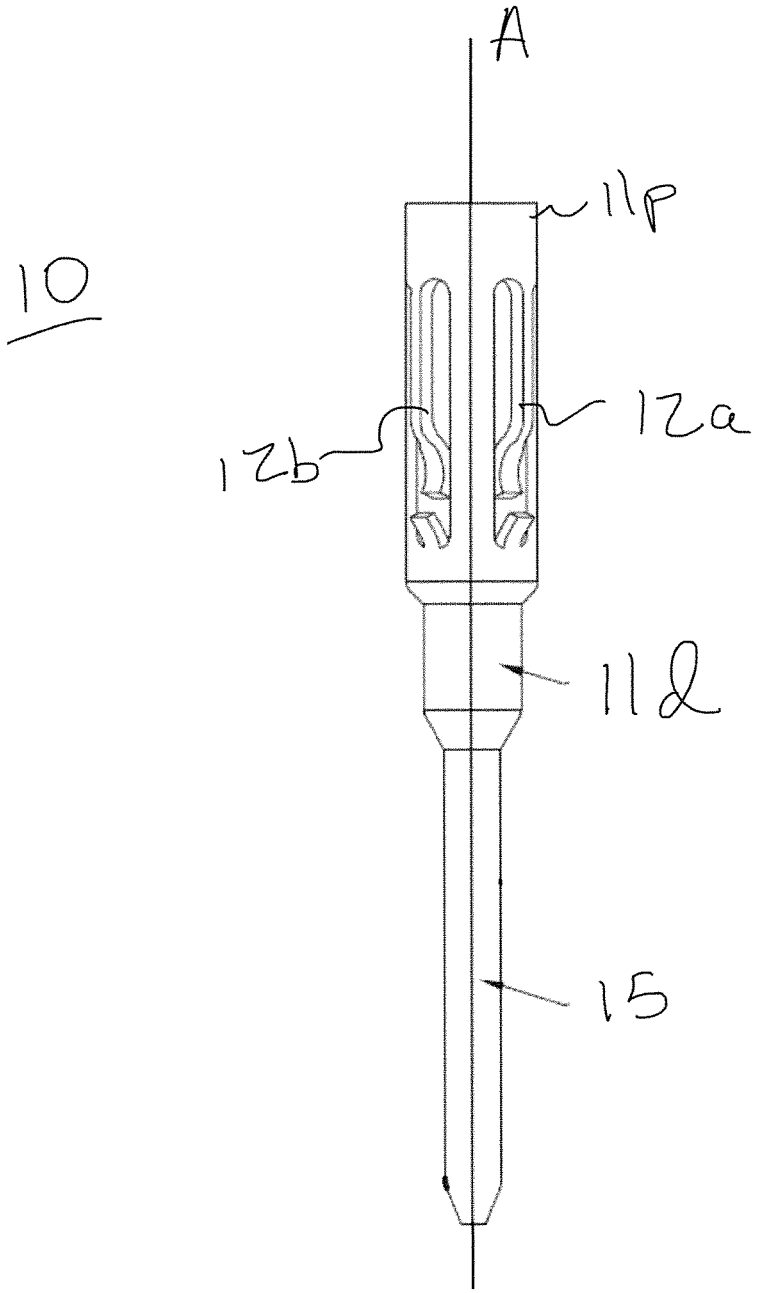
FIG. 2A is a plan view of a socket with a solder tail according to a first embodiment.
Figure 2B:
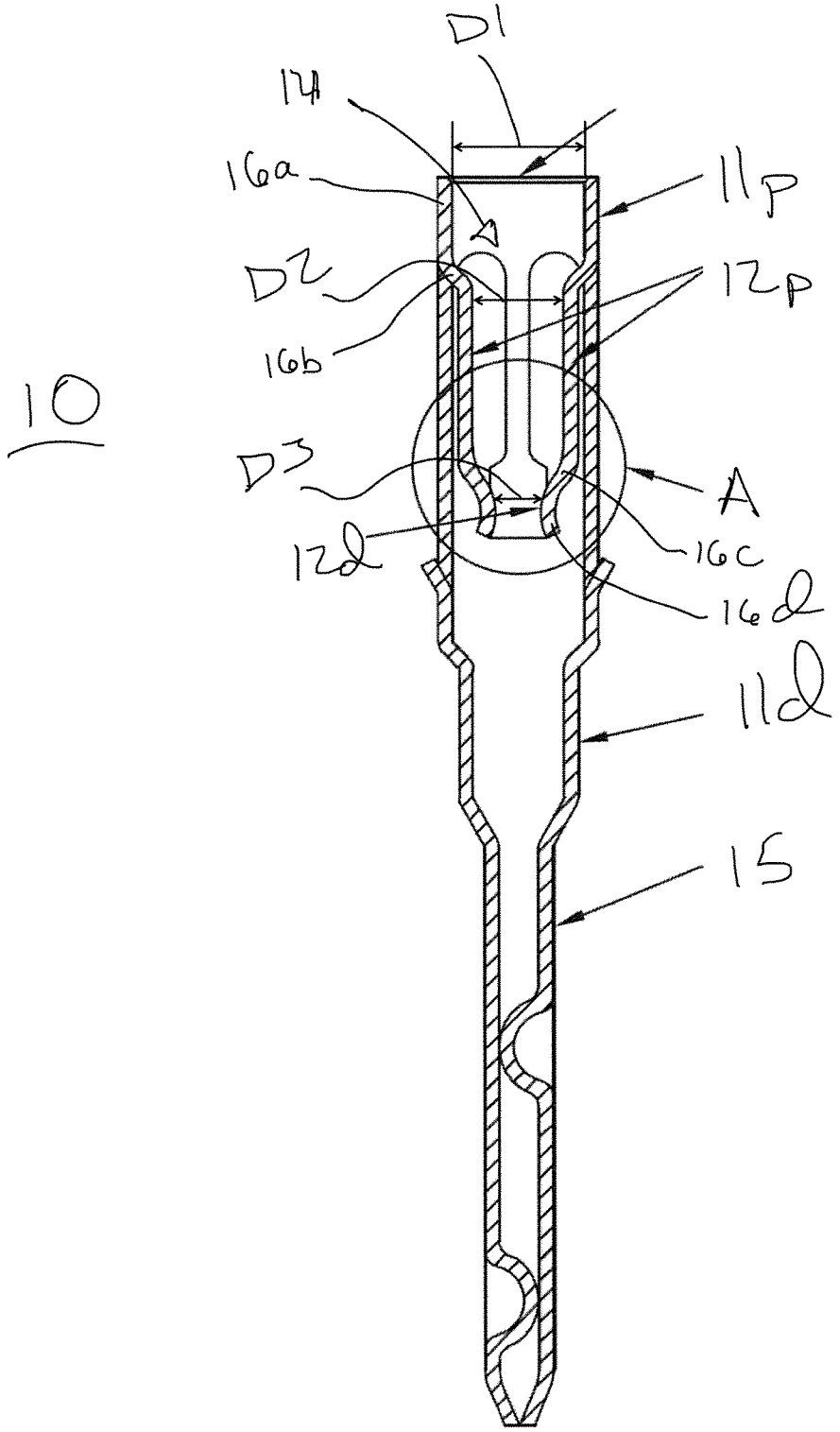
FIG. 2B is a cross-sectional view of the socket of FIG. 2A.
Figure 2C:
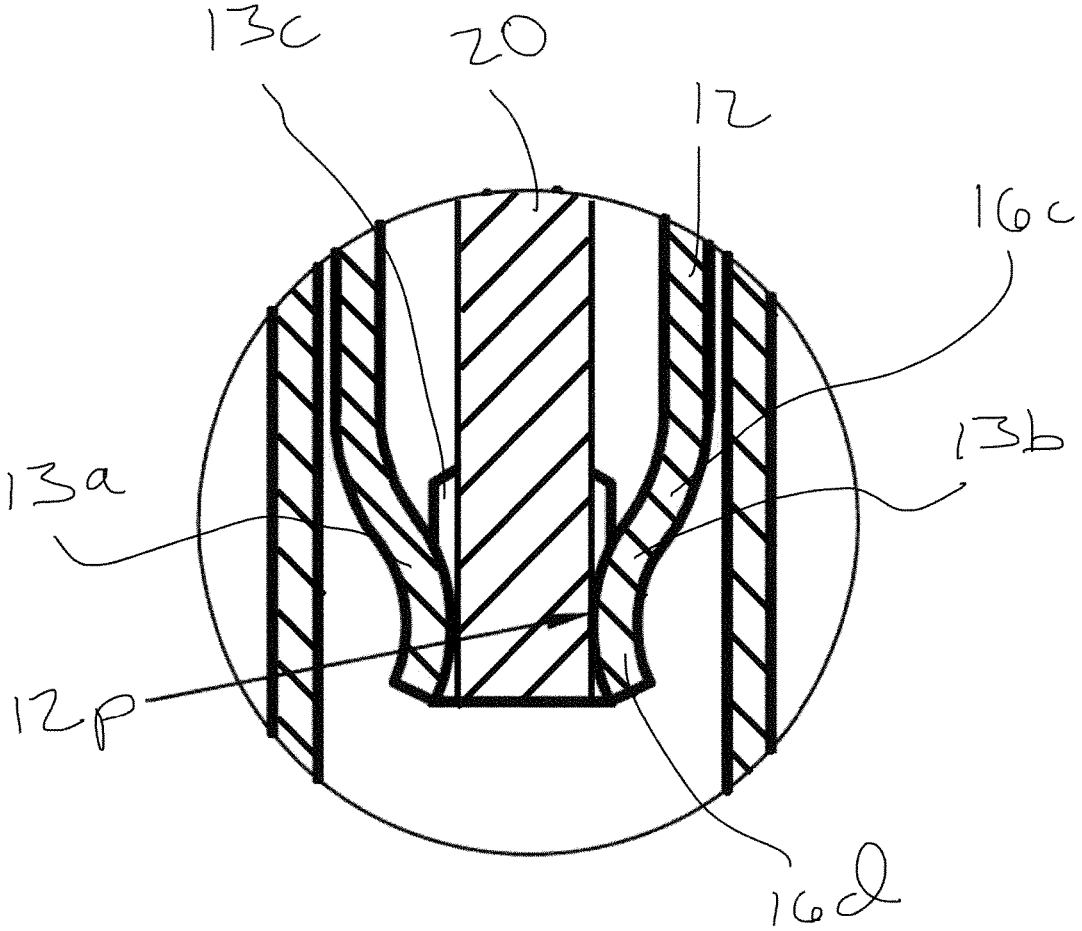
FIG. 2C is an enlarged detail view of the contact dimples as seen in circle A of FIG. 2B.

Referring to FIGS. 2A-2C, the one-piece contact 10 is shown having a solder tail extending therefrom for a thru-hole connection to a PCB, as discussed further below. The one-piece contact can include a first proximal barrel portion 16*a* having a generally cylindrical shape. The barrel portion 16*a* can have a first diameter D1 that defines an initial opening of an insertion lumen 14, extending along a central axis A, for receiving a device lead 20. The barrel portion 16*a* can have a tapering region 16*b* extending distally therefrom. In the illustrated embodiment, the tapering region 16*b* can extend distally away from the proximal barrel area 16*a* and radially inwardly towards a central axis A, to create an angled surface. Alternatively, the tapering region 16*b* can be curved, or rolled, such that it has a radius of curvature. The tapering region 16*b* can reduce the diameter of the barrel to a second diameter D2. A plurality of fingers 12*a*, 12*b*, 12*c* can extend distally from the tapered region 16*b*. The plurality of fingers 12*a-c* can have a first parallel portion 12*p* extending along a majority of their lengths. The fingers 12*a-c* can be disposed approximately at the second diameter D2 around the central axis A of the contact 10. The first parallel portion 12*p* of the respective fingers 12*a*-12*c* can be parallel to one another along the majority of their length, or along the entirety of their length. In addition to the parallel portions 12*p* being parallel to one another, they can extend parallel to the longitudinal axis A of the one-piece contact 10. As such, an inserted device lead 20 encounters no mechanical resistance as it travels downward towards the contact because the lumen 14 can have a constant diameter, D2, along the length of the parallel fingers 12*a-c*. At the distal end of each of the respective parallel portion 12*p* of the fingers 12*a-c*, a respective dimple 13*a*, 13*b*, 13*c* can be formed. Each dimple 13*a-c* can, at first region 16*c*, extend both distally and radially inward towards the central axis of the contact to a diameter D3. The dimple 13*a-c* can then, at a second region 16*d*, extend radially outward, from the distal contact point 12*d*, as it extends further distally. The contact point 12*d* of each of the respective dimples 13*a-c* can define a contact lumen for the lead of a given component. The contact point 12*d* is shown as being at the distal end of the contact 10. Due to the geometry of the dimple 13*a-c*, the contact 10 only has limited contact with the device lead 20 at the distal end of the contact. This reduced contact results in a lower friction or "wiping action." In other words, as the lead 20 makes contact with the dimples 13*a-c* that project from the fingers 12*a-c* at the distal end, as compared with the tapered fingers of the prior art, there is a reduced contact area between the contact and the lead, as seen in at least FIG. 2C. With this innovative design, insertion, withdrawal, and retention forces can be adjusted by simply changing a punch in the contact stamping tool. In the illustrated embodiment, three parallel fingers are shown, however the contact can include any number of contacts as may be required for a given lead.

Figure 3A:
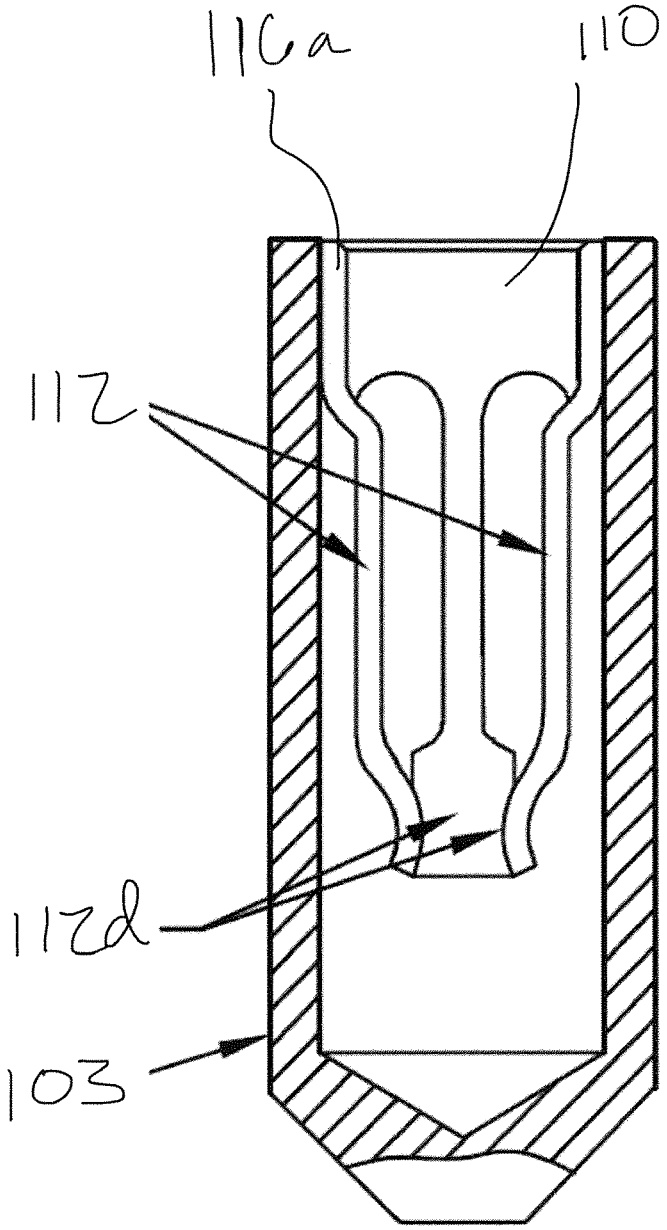
FIG. 3A is a partial cross-sectional view of a pin socket in accordance with another embodiment.
Figure 3B:
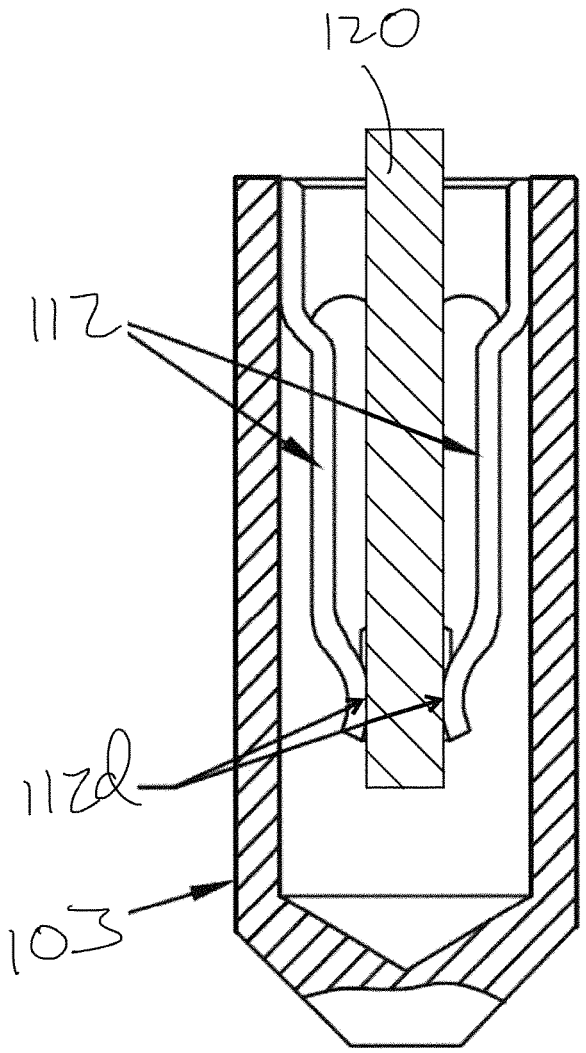
FIG. 3B is a partial cross-sectional view of FIG. 3A with a device lead disposed therein.

In an alternative embodiment, as shown in FIGS. 3A and 3B, the one-piece contact can be composed of two pieces, an internal contact portion 110 and an external shell 103. This embodiment can be substantially similar to the embodiment of FIGS. 2A-2C. However the upper barrel portion 116*a* of the contact 110 can be configured and arranged to be received in the shell 103 by means of a friction fit, or other fixation means. The remainder of the contact 110 is substantially similar to the one-piece contact 10 of FIGS. 2A-C. For example, the contact 110 includes parallel fingers 112 which contact a device lead 120 at a distal end 112*d* of the contact. As such, a discussion of the geometry of contact 110 will be omitted for the sake of brevity.

The one-piece parallel multi-finger contact 10 design can be implemented, for example, in both through-hole and surface mount requirements, respectively. For through-hole requirements, a contact 10 can be inserted into a plated-through hole that is drilled into the PCB. Below the barrel 11*d* of each contact a solder tail 15 can extend such that it protrudes to the opposite end of the PC board. The tails 15 can then be wave soldered, spot soldered, or hand soldered to form an electrical connection between the device leads, the present pin socket, and the PCB—once the contact 10 has been disposed in the through hole.

Figure 4C:
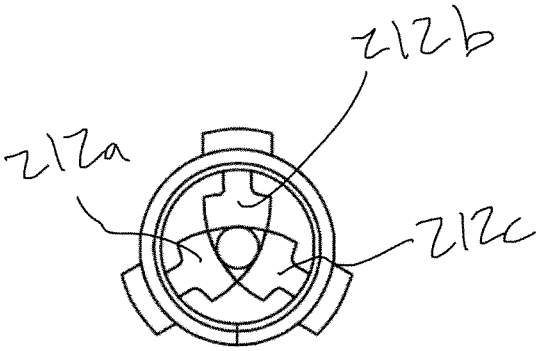
FIG. 4C is a top view of the surface mount embodiment of FIG. 4A.
Figure 4A:
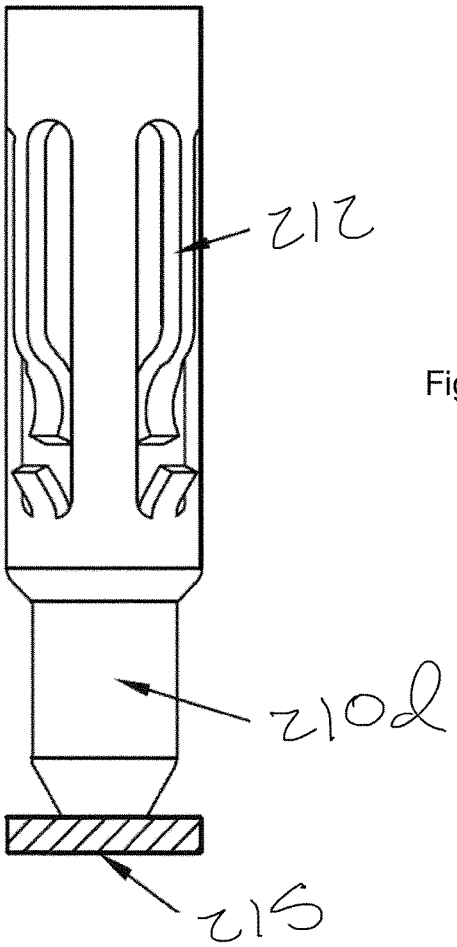
FIG. 4A is a plan view of a surface mount embodiment of a pin socket.
Figure 4B:
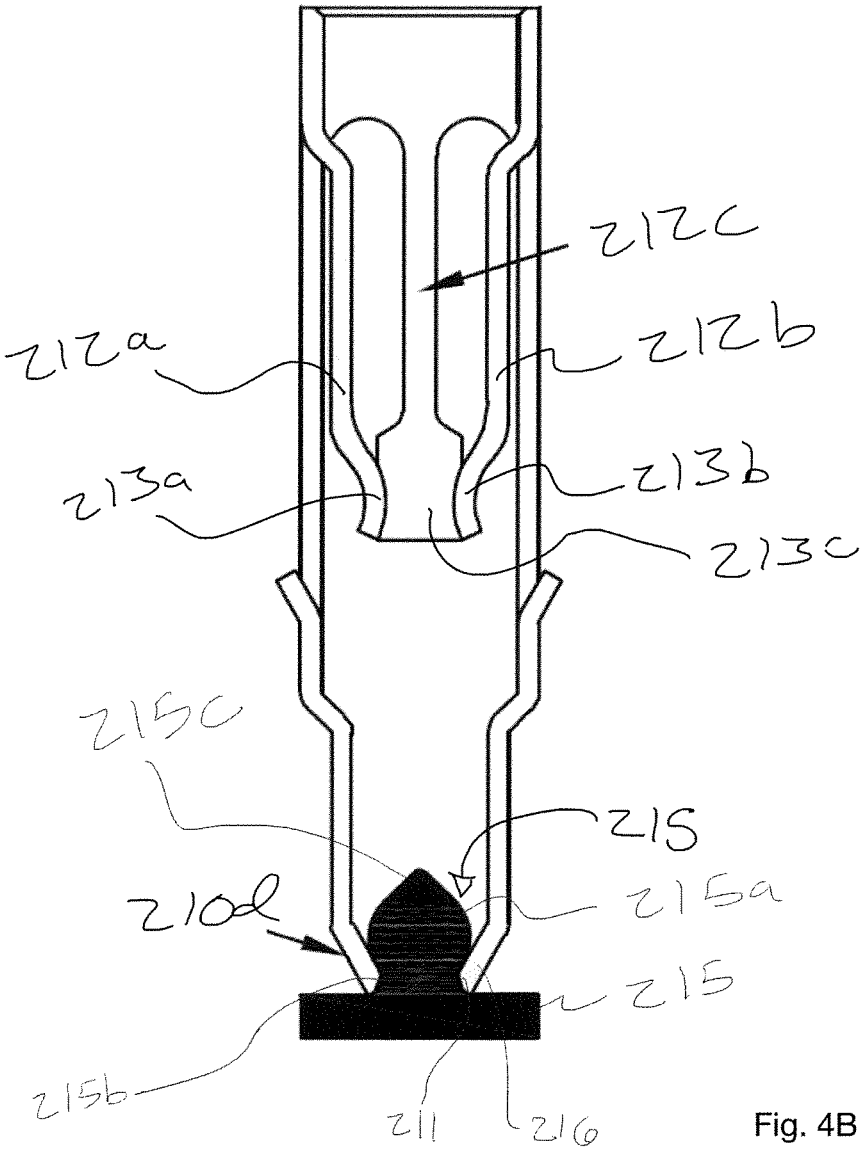
FIG. 4B is a cross-sectional view of the surface mount socket of FIG. 4A.

Alternatively, the contact can be used in plurality of surface mount configurations, as shown in FIGS. 4A-6B. The structure of the barrel portions and parallel fingers for each of these alternative embodiments is structurally similar to that of the embodiment of FIGS. 2A-2C. Thus, for the sake of brevity, a discussion of the parallel fingers and dimples will be omitted. For surface mount configurations, the upper portion, or contact, 210, 310, 410 of the socket design can be structurally similar to the contact 10 of the through-hole design, but at the distal end, the solder tail is replaced with one of three variations. In a first embodiment, as shown in FIGS. 4A-4C, a distal most end 210*d* of the contact 210 can include a tapered portion 216 having a through-hole 211 into which a tapered turned metal part 215 can be inserted. The turned metal part 215 can include a head 215*a*, undercut 215*b*, and taper 215*c* (at the smaller end diameter). The turned metal part 215 can be inserted into the hole taper end 215*c* first. The turned metal part, or pin, 215 can lock into the undercut 215*b* of the contact 210 to prevent solder from wicking up into the contacting area where the contact dimple 213*a*, 213*b*, 213*c* is located on the parallel fingers 212*a*, 212*b*, 212*c*.

Figure 5C:
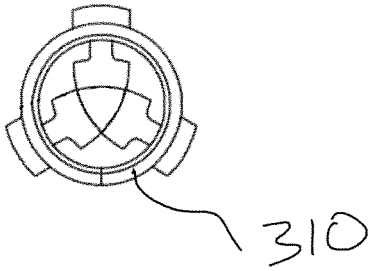
FIG. 5C is a top view of the alternative mount socket FIG. 5A.
Figure 5A:
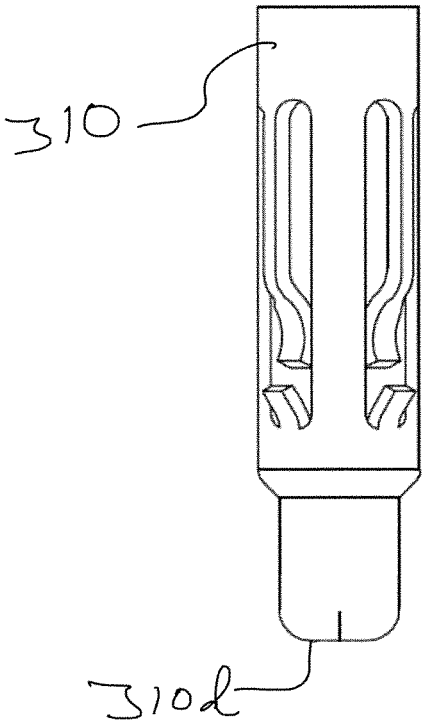
FIG. 5A is a plan view of an alternative mount socket.
Figure 5B:
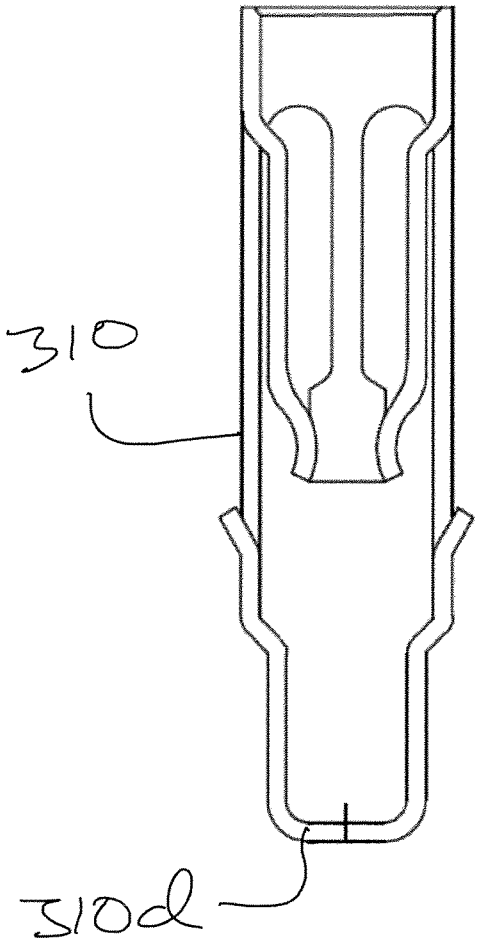
FIG. 5B is a cross-sectional view of the alternative mount socket of FIG. 5A.
Figure 6A:
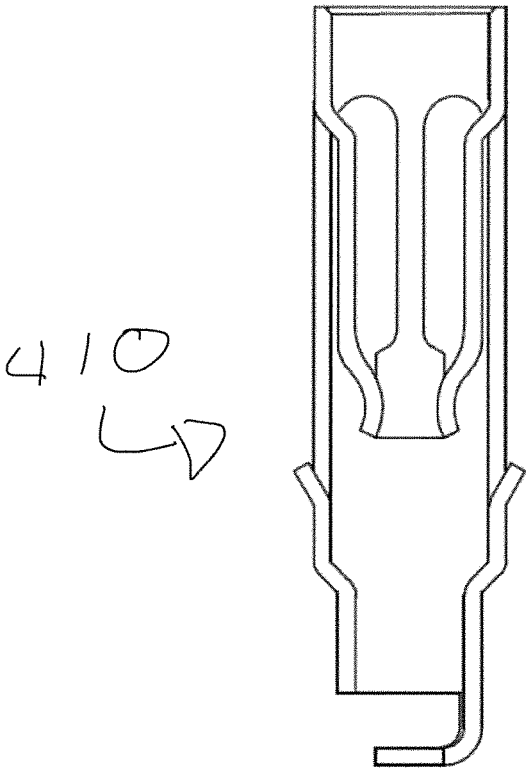
FIG. 6A is a cross-sectional view of further alternative surface mount embodiment of a pin contact.
Figure 6B:
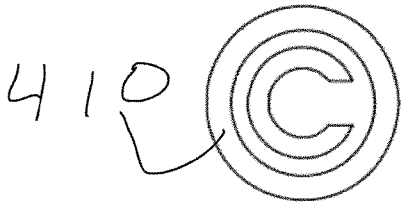
FIG. 6B is a bottom view of the further alternative surface mount contact of FIG. 6A.

In a second embodiment, as shown in FIGS. 5A-5C, a contact 310 can include a distal most face 310*d* which can be flat, to form a flat surface where the contact 310 can rest on the PCB pad. FIGS. 6A and 6B define a further alternative contact 410 with alternative contact structure. In either surface mount embodiment, the contact 310, 410 is then vapor phase or convection soldered to a pad on the top surface of the PCB.

The instant one-piece parallel multi-finger contact design has three (3) key benefits over today's commercially available two-piece tapered multi-finger contact. First, the one-piece design eliminates four (4) of the eight (8) steps involved to produce the contact, leaving only stamping, forming, heat treating, and plating the contact. As such, the instant method of manufacturing can significantly reduce the socket lead times while increasing process consistency. A second benefit is that the dimple can provide for a more predictable and consistent insertion, retention, and withdrawal forces due to the shorter contact region, as discussed above. Third, by making contact with the device leads at the distal end of the contact, compared to the proximal end of the prior art, where the dimples are located, the parallel (versus tapered) contact has a much lower insertion force—eliminating the device lead damage and device substrate cracking associated with high insertion forces.

Variations of this parallel, dimpled contact can also be used in place of a traditional tapered contact inserted into a terminal—to likewise avoid device lead damage and substrate cracking associated with high insertion forces. The one piece parallel multi-finger contact can be press fitted into any hole—whether a PCB hole or the barrel/shell of a through-hole or surface mount terminal.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claim.

What is claimed is:

1. An electronic device socket comprising:

a barrel having a lumen extending therethrough, the barrel comprising, a proximal barrel portion having a first outer diameter;

a tapering region extending distally from the proximal barrel portion, the tapering region extending both distally and radially inward towards a central axis of the barrel defining a second diameter which is smaller than the first diameter;

a plurality of fingers extending distally from the tapering region, the plurality of fingers are all parallel to one another and the central axis;

a dimple contact area extending from each of the plurality of fingers extending radially inward and distally.

2. The electronic device socket of claim 1 wherein said plurality of fingers are three fingers.

3. The electronic device socket of claim 1 wherein each of said dimples extend radially outward at a location distal to the radially inward section.

4. The electronic device socket of claim 1 wherein the barrel is configured to make full contact with an electronic pin only at the dimple contact area.

5. The electronic socket of claim 1 wherein said electronic socket is configured and arranged as a contact disposed in a printed circuit board by surface mounting or in a through-hole.

6. The electronic socket of claim 5 wherein said contact includes a solder tail extending distally therefrom to attach the contact to the printed circuit board.

7. The electronic socket of claim 5, wherein the contact is soldered to the printed circuit board.

8. The electronic socket of claim 5, wherein the contact includes a tapered plug disposed in a distal end thereof.

9. The electronic socket of claim 8, wherein the contact includes a locking feature which locks the tapered plug into an undercut of the distal end of the contact.

10. The electronic socket of claim 1, wherein the socket is one piece.

11. The electronic socket of claim 1, wherein the socket is press fitted into an outer shell.

12. A one piece parallel multi-finger contact configured for mounting electronic devices to a printed circuit board, the contact comprising:

a barrel having a first diameter;

a plurality of parallel beams extending distally from the barrel, the plurality of beams disposed about a second diameter which is smaller than the first diameter; and a point of contact distal to the plurality of parallel beams defined by a respective dimple on each of the plurality of parallel beams, wherein, the point of contact is radially inward of both the barrel and the plurality of parallel beams.

13. The contact of claim 12, wherein the plurality of parallel beams are parallel to a central axis of the contact.

14. The contact of claim 12, wherein the plurality of parallel beams are parallel to one another along a majority of the length of the contact.

15. The contact of claim 12, wherein each of the respective dimples extend radially inward and distally from a respective parallel beam and then radially outward and distally.

16. The contact of claim 12, wherein the plurality of parallel arms is three parallel beam.

17. A method of manufacturing a one piece parallel multi-finger contact, the method consisting of:

a) stamping a piece of metal to create a multi-finger contact;

b) forming a dimple on a distal end each of the fingers of the multi-finger contact;

c) heat treating the multi-finger contact; and d) plating the contact.

18. The method of claim 17, wherein the multi-finger contact comprises a barrel, a plurality of fingers extending distally therefrom, each of the fingers parallel to one another, and a respective dimple extending distally from each of the plurality of fingers.

19. The method of claim 18, wherein the plurality of fingers are parallel to one another along a majority of the length of the contact.

20. The method of claim 18, wherein each of the respective dimples extend radially inward and distally from a respective finger and then radially outward and distally.

* * * * *